United States Patent [19]

Studeny et al.

[11] 3,938,818

[45] Feb. 17, 1976

[54] DRAW PALLETT AND METHOD OF MAKING SAME

[75] Inventors: Hermann Studeny, Niederkassel; Holger Bultmann, St. Augustin, both of Germany

[73] Assignee: Dynamit Nobel Aktiengesellschaft, Germany

[22] Filed: Feb. 13, 1974

[21] Appl. No.: 442,251

[30] Foreign Application Priority Data

Feb. 13, 1973 Germany ..... 73053108[u]

[52] U.S. Cl. ..... 280/19

[51] Int. Cl.[2] ..... B62B 15/00

[58] Field of Search ..... 280/19, 18, 12 R; 214/351

[56] References Cited

UNITED STATES PATENTS

| | | | |
|---|---|---|---|
| 3,140,878 | 7/1964 | Davis | 280/18 |
| 3,771,808 | 11/1973 | Duerst | 280/19 |

*Primary Examiner*—Robert R. Song

*Attorney, Agent, or Firm*—Craig & Antonelli

[57] ABSTRACT

A draw pulling pallet and method of making same, wherein the pallet is constructed of a thin flexible sheet of resinous material, preferably thermoplastic synthetic resinous material, which has been roughened on one side to prevent slippage of cargo therefrom. In preferred embodiments, the side of the sheet is roughened by longitudinally extending grooves and/or rhomboid pattern grooves. Preferred embodiments also include markings indicating the direction which the pallet is to be pulled. In one preferred embodiment, these markings are in the form of arrow shaped embossments and in other preferred embodiments, these markings are in the form of longitudinally extending colored embossments adjacent one side of the pallet. Preferred embodiments of the pallets also include perforations for accommodating drainage of water therefrom. Also, the pulling end or edge of the pallets includes reinforcements in the form of bevelling of the thin sheet of material and/or in the form of reinforcing bars mounted in a flanged-over edge of the sheet. These reinforcements, particularly the reinforcing bar and adjacent flanged-over edge portion of the sheet also serve as attachment points for clamping means of a truck or the like which is to pull the pallet during conveyance of goods stacked thereon.

29 Claims, 4 Drawing Figures

DRAW PALLETT AND METHOD OF MAKING SAME

BACKGROUND AND SUMMARY OF THE INVENTION

The present invention relates to a draw or pulling pallet for the conveyance of stackable piece goods or cargo, as utilized, for example, in connection with forklift trucks as the transportation means. It is known to make these type of pallets of wood or other materials, such as metal sheets, for example. However, the use of wooden pallets, for instance, entails a high expenditure in originally buying the pallets and relatively high freight costs for the return of empty pallets due to the weight and bulkiness thereof.

The present invention contemplates providing a readily manipulatable draw pallet at a minimum of cost, which renders the conveyance of the cargo as economical as possible.

More specifically, the present invention contemplates providing a draw pallet constructed to be flexible with a roughened and/or embossed surface on one side. The present invention further contemplates constructing such pallets preferably of a thermoplastic synthetic resin of high strength. Preferred embodiments of pallets constructed in accordance with the present invention include a fabric-like reinforcing insert of glass or cloth fabric, a synthetic resin fabric, and similar materials. Preferred embodiments of draw pallets of this invention are constructed of especially high-pressure polyethylene, low-pressure polyethylene, soft and hard PVC, and rubber; with and without fabric inserts.

The draw pallets of the present invention are distinguished in that they can be used repeatedly under high weight loads. The cargo is safely prevented from sliding off due to the roughened and/or embossed pallet surface on the cargo contacting side. Additionally, the draw pallets have a low weight, because only a minor thickness, preferably in the range of about 1 ½ mm., is required for the pallet, due to the use of particularly thermoplastic synthetic resins. Furthermore, the draw pallets of this invention are weatherproof and can be utilized in a temperature range of from −50° to +70° C. Also the high abrasion resistance and resistance to chemicals of the synthetic resins employed prove to be advantageous.

In order to make it possible to drain rain water or water of condensation from the pallets, a further feature of certain preferred embodiments of this invention include perforations, wherein many desired geometrical shapes for the perforations and arrangements of the holes are contemplated. As a consequence of these perforations, it also becomes feasible to stack cargo in the open air with the use of the draw pallets of this invention.

To facilitate transporting with the draw pallets with the stacked cargo by means of forklift trucks or stacking trucks or the like, which are equipped with a clamping slide for seizing the draw pallet, advantageous preferred embodiments of the invention include embossed arrows and/or colored strips extruded in the material which mark the drawing directions. Simultaneously a handle is formed for the clamping slide of the truck. Preferred embodiments of the draw pallets include strengthed edge portions and/or beveled edge portions in the drawing direction or at the drawing end or side of the pallets. Further preferred embodiments of the invention include a reinforcing rail or bar incorporated into the edge of the pallet, which bar or rail serves as the pulling handle or strap for connecting the clamping slide of the truck which pulls the draw pallet.

The draw pallets of the present invention also lend themselves to being manufactured in various colors in accordance with another advantageous feature of the present invention, so that the differently colored draw pallets can be utilized also for the respective characterization or marking of cargo placed thereon.

The strength of the draw pallets and the respective load bearing capacity made possible thereby are achieved in accordance with the present invention by the use of suitable synthetic resin and/or glass fabrics which are introduced during the manufacturing process and/or applied or mounted in a subsequent laminating process.

As compared to conventional draw pallets, the draw pallets of this invention are also distinguished by the low space requirement during use and during nonuse, i.e. during storage and return. Furthermore, the draw pallets have a relatively low weight, so that they can be easily handled.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
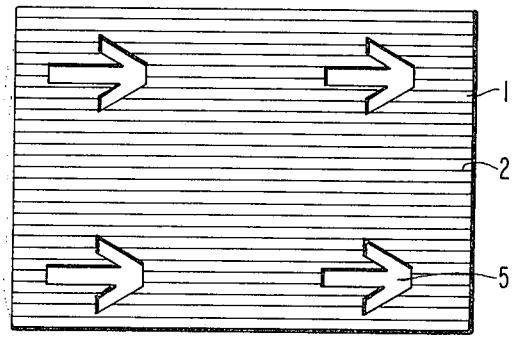
FIG. 1 is a schematic plan view of a draw pallet constructed in accordance with a first preferred embodiment of the present invention.

The draw pallet 1 of FIG. 1 is provided with a roughened surface on one side (side to be contacted by cargo), with grooves 2 formed, for example, by means of a wire brush. Embossed arrows 5 are disposed on the roughened surface side and indicate the direction which the pallet should be pulled. The pulling edge of the draw pallet is reinforced by means of a reinforcing rail 7 inserted in a flanged-over edge, as can be seen from FIG. 4. The flanged over-edge which encloses rail 7 serves as a handle for accommodating clamping of the draw pallet by a clamping slide of a truck or the like.

Figure 2:
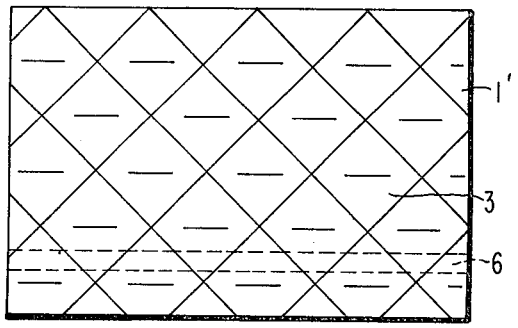
FIG. 2 is a view similar to FIG. 1 showing another preferred embodiment of a draw pallet constructed in accordance with the present invention.

In the draw pallet 1' according to FIG. 2, the surface is roughened on the upper cargo contacting side by embossing in rhomboid configuration 3. The marking of the drawing direction in the FIG. 2 embodiment is effected by means of a colored strip 6 which is continuously extruded into the pallet over the length thereof at one predetermined side of the centerline thereof.

Figure 3:
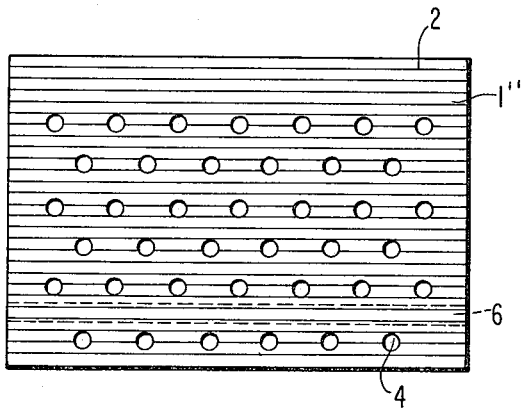
FIG. 3 is a view similar to FIG. 1 showing yet another preferred embodiment of a draw pallet constructed in accordance with the present invention.

FIG. 3 shows another embodiment of a draw pallet 1'' of this invention, fashioned with one surface roughened by means of grooves 2 (similar to grooves 2 of FIG. 1) and equipped with a continuous colored strip 6 (similar to strip 6 of FIG. 2) to mark the pulling direction. Perforations 4 through the pallet 1'' are provided in mutually offset rows so that any rain water or the like can drain away when the stacked cargo is stored in the open air.

Figure 4:
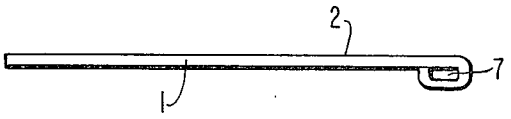
FIG. 4 is a cross-sectional view through a draw pallet constructed in accordance with FIG. 1.

The reinforcing rail 7 arrangement of FIG. 4 is included in the embodiments of FIGS. 2 and 3 as well as in the FIG. 1 embodiment.

Preferred embodiments of the drawing pallets constructed in accordance with the present invention have a width in the range between 1 and 1.5 meters, a length in the range of 1 to 2 meters and a thickness in the range between 1.5 and 3 mm. It would be understood that the length dimension is in the pulling or drawing direction of the pallets.

In use, the drawing pallets are slidably pulled onto a supporting base of a lift truck by a clamping slide, together with whatever load is resting on the pallets. After transportation of the pallets and the load stacked thereon, the pallets and load are pushed off the supporting base of the lift truck. It is also contemplated to use the pallets with arrangements which retain the pallet on the lift truck while pushing the load off of the pallet. Dynamit Nobel AG, Mar. 1973 Brochure No. 15 contains further details of use environment contemplated by the present invention.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Draw pallet for conveying stackable cargo comprising:

a thin flexible sheet of high strength resinous material, said thin flexible sheet defining perforations therein for accommodating drainage of water therethrough, and roughening means on one side of said thin sheet for limiting sliding of cargo stacked on said one side.

2. Draw pallet according to claim 1, wherein said roughening means includes grooves formed in said resinous material at said one side of said thin sheet.

3. Draw pallet according to claim 1, wherein said draw pallet is formed substantially completely by said thin sheet of resinous material.

4. Draw pallet according to claim 1, wherein said thin sheet of resinous material is reinforced by a fabric-like reinforcing insert of one of glass fabric, synthetic resin fabric, and the like.

5. Draw pallet according to claim 1, wherein said resinous material is selected from the group consisting of high pressure polyethylene, low pressure polyethylene, polyvinyl chloride, and rubber.

6. Draw pallet according to claim 1, wherein said thin sheet is approximately 1.5 mm thick.

7. Draw pallet according to claim 1, wherein said roughening means is capable of limiting sliding of cargo stacked on said one side while the portion of the flexible sheet on which said cargo rests is essentially flat.

8. Draw pallet according to claim 1, wherein the lateral edge portions of said thin flexible sheet are continuous.

9. Draw pallet according to claim 1, wherein the lateral edge portions of said thin flexible sheet are formed substantially completely from said thin sheet of resinous material.

10. Draw pallet according to claim 9, wherein the leading edge of said thin flexible sheet includes reinforcing means.

11. Draw pallet according to claim 1, wherein said perforations are located in a central portion of said thin flexible sheet.

12. Draw pallet according to claim 11, wherein the lateral edge portions of said thin flexible sheet are continuous.

13. Draw pallet according to claim 11, wherein the lateral edge portions of said thin flexible sheet are formed substantially completely from said thin sheet of resinous material.

14. Draw pallet for conveying stackable cargo comprising:

a thin flexible sheet of high strength resinous material, roughening means on one side of said thin sheet for limiting sliding of cargo stacked on said one side, and visible marking means on said one side which indicates a predetermined desired drawing direction for said pallet, said marking means including arrow-shaped embossments formed in said resinous material at said one side.

15. Draw pallet according to claim 14, further comprising perforations through said thin sheet for accommodating drainage of water therethrough.

16. Draw pallet according to claim 1, further comprising reinforcing means at an edge of said thin sheet, said reinforcing means including handle means for clamping said pallet to a vehicle for slidably pulling the pallet.

17. Draw pallet according to claim 16, wherein said reinforcing means includes a reinforcing rail enclosed within an edge portion of said thin sheet which also forms a pulling handle or strap for said pallet.

18. Draw pallet for conveying stackable cargo comprising:

a thin flexible sheet of high strength resinous material, roughening means on one side of said thin sheet for limiting sliding of cargo stacked on said one side, and visible marking means on said one side which indicates a predetermined desired drawing direction for said pallet, said marking means including at least one strip extruded into said resinous material, said strip being of a color different than the color of the adjacent visible surface of the thin sheet of said resinous material.

19. Draw pallet according to claim 18, further comprising perforations through said thin sheet for accommodating drainage of water therethrough.

20. Draw pallet for conveying stackable cargo comprising:

a thin flexible sheet of high strength resinous material, roughening means on one side of said thin sheet for limiting sliding of cargo stacked on said one side, visible marking means on said one side which indicates a predetermined desired drawing direction for said pallet, and perforations through said thin sheet for accommodating drainage of water therethrough.

21. Draw pallet for conveying stackable cargo comprising:

a thin flexible sheet of high strength resinous material, roughening means on one side of said thin sheet for limiting sliding of cargo stacked on said one side, and reinforcing means at an edge of said thin sheet including handle means for clamping said pallet to a vehicle for slidable pulling said pallet.

22. Draw pallet according to claim 21, wherein said reinforcing means includes a reinforcing rail enclosed within an edge portion of said thin sheet which also forms a pulling handle or strap for said pallet.

23. Draw pallet for conveying stackable cargo comprising:

a thin flexible sheet of high strength resinous material, roughening means on one side of said thin sheet for limiting sliding of cargo stacked on said one side, visible marking means on said one side which indicates a predetermined desired drawing direction for said pallet, and reinforcing means at an edge of said thin sheet, said reinforcing means including handle means for clamping said pallet to a vehicle for slidably pulling the pallet.

24. Draw pallet according to claim 23, wherein said reinforcing means includes a reinforcing rail enclosed within an edge portion of said thin sheet which also forms a pulling handle or strap for said pallet.

25. Draw pallet for conveying stackable cargo comprising:

a thin flexible sheet of high strength resinous material, and roughening means on one side of said thin sheet for limiting sliding of cargo stacked on said one side, the edge of the thin sheet facing said pallet being beveled in a predetermined drawing direction.

26. A method of making a draw pallet comprising:

forming a thin sheet of high strength synthetic resinous material, roughening one side of said thin sheet to limit sliding of cargo therefrom, and marking said thin sheet by embossing arrows on said one side to indicate a predetermined pulling direction for said pallet.

27. A method according to claim 26, further comprising perforating said thin sheet to form water drain holes therethrough.

28. In a method for conveying stackable cargo in which stackable cargo is stacked on a draw pallet and said draw pallet together with the stack of stackable cargo thereon is transported by transportation means adapted to carry said draw pallet and said stack the improvement wherein said draw pallet comprises a thin flexible sheet of high-strength resinous material, and roughening means on one side of said thin sheet for limiting sliding of cargo stacked on said one side, the lateral edge portions of said thin flexible sheet being formed substantially completely from said thin sheet of resinous material, said draw pallet defining perforations through the central portion of said thin sheet for accommodating drainage of water therethrough.

29. In a method for conveying stackable cargo in which stackable cargo is stacked on a draw pallet and said draw pallet together with the stack of stackable cargo thereon is transported by transportation means adapted to carry said draw pallet and said stack, the improvement wherein said transportation means is a lift truck, said draw pallet being slidably pulled onto a supporting base of said lift truck, said draw pallet comprising a thin flexible sheet of high-strength resinous material and roughening means on one side of said thin sheet for limiting sliding of cargo stacked on said one side.

* * * * *